US005770521A

United States Patent [19]

Pollock

[11] Patent Number: 5,770,521

[45] Date of Patent: Jun. 23, 1998

[54] ANTI-SHEAR METHOD AND SYSTEM FOR SEMICONDUCTOR WAFER REMOVAL

[75] Inventor: John J. Pollock, Bloomington, Minn.

[73] Assignee: Cypress Semiconductor Corporation, San Jose, Calif.

[21] Appl. No.: 657,718

[22] Filed: May 30, 1996

[51] Int. Cl.[6] ..... H01L 21/00

[52] U.S. Cl. ..... 438/692; 156/345; 216/88

[58] Field of Search ..... 156/345; 216/38, 216/52, 88, 89, 91; 438/690, 691, 692, 693

[56] References Cited

U.S. PATENT DOCUMENTS 5,593,537 1/1997 Cote et al. ..... 216/88 X

*Primary Examiner*—William Powell

*Attorney, Agent, or Firm*—Dykema Gossett PLLC

[57] ABSTRACT

A method and system for removing an 8-inch semiconductor wafer from a final polishing pad of a Chemical Mechanical Polishing machine is disclosed. The polishing machine includes a rotating platen, and a polishing pad affixed thereto for rotation therewith. Moreover, the machine includes a generally-cylindrical carrier portion rotatable about an axis of rotation for receiving and retaining the semiconductor wafer. During normal operation, the platen and carrier both rotate about their respective axes of rotation, while, in addition, the carrier is oscillated by a mechanical arm along the surface of the polishing pad in a substantially radial path, relative to the axis of the platen. Prior to removing the wafer, the platen and carrier rotation is discontinued, while the radial movement of the carrier is allowed to continue for predetermined number of oscillations during a predetermined time to thereby dissipate adhesion forces inhibiting removal of the wafer.

20 Claims, 2 Drawing Sheets

ANTI-SHEAR METHOD AND SYSTEM FOR SEMICONDUCTOR WAFER REMOVAL

BACKGROUND OF THE INVENTION

1. Field of the Invention

The present invention relates generally to fabrication techniques for semiconductor structures, and, more particularly to an improved method and system for removing a semiconductor wafer from a chemical/mechanical polishing (CMP) machine.

2. Description of the Related Art

One step in the fabrication process of semiconductor devices is a so-called Chemical Mechanical Polishing (CMP) step of a silicon wafer. Multiple steps having varying abrasion characteristics may be used to produce a successively smoother, and, in particular, more planar, wafer surface. Specialized apparatuses are employed to perform these polishing steps.

In a common configuration, such a machine employs a mechanical arm movable in several axes, a generally cylindrical wafer-sized carrier portion, and a platen rotatable about an axis of rotation for receiving a polishing pad for rotation therewith. The carrier is coupled to one end of the mechanical arm, and employs vacuum pressure to pick up a silicon wafer from a holding area, and, thereafter, move the wafer to a location proximate the rotating polishing pad. The polishing pad, in a typical configuration, is used in connection with an abrasive fluid to effect polishing. The mechanical arm is movable towards the polishing pad so that the silicon wafer engages the pad. Polishing occurs from the application of a predetermined downward force by the mechanical arm onto the wafer while the pad rotates at a predetermined speed. Typically, the carrier itself rotates about its central axis, and is moved by the mechanical arm back and forth across the polishing surface to obtain even polishing action.

A problem arose in removing the wafer from the polishing pad. In particular, due to the polishing fluid employed, a force of adhesion was created between the wafer, and the polishing pad, thus resisting separation of the wafer from the polishing pad.

Two approaches in the art have been taken in an attempt to deal with the above-mentioned separation-resisting force. The first method involves moving the mechanical arm to the side of the polishing pad so that the wafer is moved partially off of the pad. This technique is known as the "Edge Lift" technique. A second approach taken by the art is to increase the rotational speed of the polishing platen and/or the carrier so that the semiconductor wafer literally "shears" off the polishing pad. This technique is a so-called "Shear" method.

While the "edge lift" method, and the "shear" method performed adequately with respect to 6-inch semiconductor wafers, neither technique performed well with 8-inch semiconductor wafers, due to, in part, the increased surface area of the wafer contacting the polishing pad. In particular, the 8-inch semiconductor wafers would very frequently remain engaged to the polishing pad, notwithstanding the upward force applied by the mechanical arm. This situation would cause an alarm to go off, thus disrupting the process. Alternatively, some semiconductor wafers were dropped on the polishing pad when the mechanical arm attempted withdrawal of the wafer therefrom. This also disrupted the polishing process, as well as damaging the semiconductor wafer in certain instances.

Accordingly, there is a need to provide an improved method and system for operating a semiconductor wafer polishing apparatus that minimizes or eliminates one or more of the problems as set forth above.

SUMMARY OF THE INVENTION

It is an object of the present invention to provide a system and method that substantially reduces, or eliminates the sticking of semiconductor wafers on a Chemical Mechanical Polishing machine polishing pad. It is a further object of the present invention to provide a system and method that substantially reduces or eliminates dropped semiconductor wafers upon removal from the polishing pad. It is still another object of the present invention to substantially reduce or eliminate disruptions, or interruptions to a semiconductor wafer polishing process to thereby reduce or eliminate costly downtime. It is yet another object of the present invention to substantially reduce or eliminate semiconductor wafer damage from being dropped upon removal from the polishing pad.

To achieve these and other objects, and in accordance with the present invention, an apparatus for polishing a semiconductor wafer is provided and which includes, in a preferred embodiment, a platen, a carrier, an arm member, and a controller. During normal operation, the controller is responsive to a first predetermined operating strategy stored in memory for simultaneously rotating the platen and carrier about their respective axes of rotation, while moving, using the arm member, the carrier between first and second positions on the surface of the polishing pad, to thereby polish the semiconductor wafer. When the polishing cycle has been completed, the controller is further responsive to a second predetermined strategy stored in the memory for discontinuing rotation of the platen and the carrier. The controller maintains movement of the carrier (and thus also of the semiconductor wafer) between third and forth positions on the surface of the polishing pad.

In one embodiment, the third and fourth positions substantially correspond to the first and second positions (i.e., the same oscillating motion of the carrier is maintained), and are defined by a substantially radially path, relative to the axis of rotation of the polishing pad. The path may be traversed a predetermined number of times, during a predetermined total time. This action reduces the amount of fluid between the wafer and the polishing pad whereby a separation-resisting force between the polishing platen and the wafer is reduced to enable the carrier and the wafer to be moved away from the polishing platen without the wafer either sticking to the pad, or, being dropped, as described above.

Other objects, features, and advantages of the present invention will become apparent to one skilled in the art from the following detailed description and accompanying drawings illustrating features of this invention by example, but not by way of limitation.

DETAILED DESCRIPTION OF THE PREFERRED EMBODIMENTS

Figure 1:
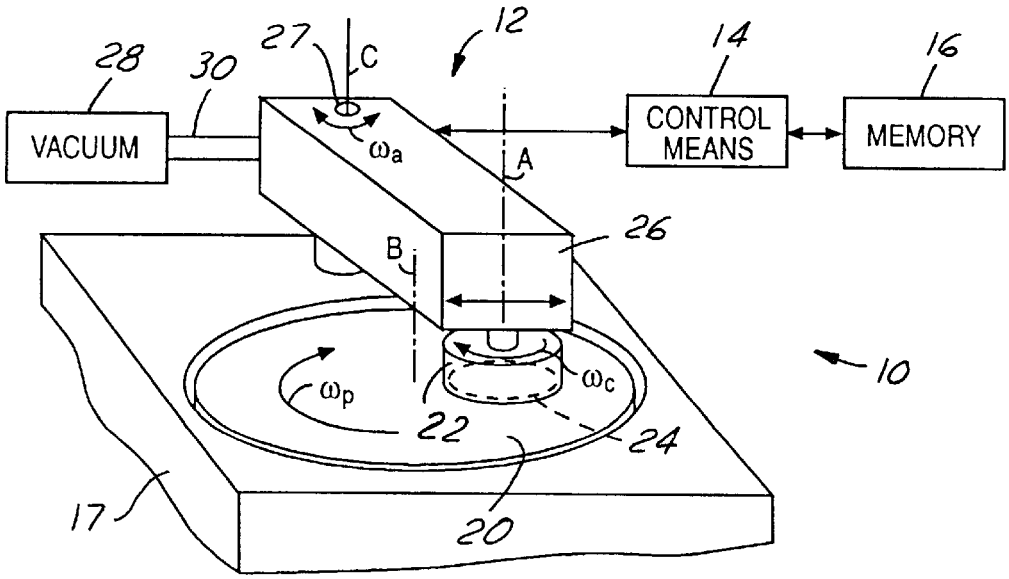
FIG. 1 is a diagrammatic, perspective view of one preferred polishing machine embodiment according to the present invention.

Referring now to the drawings wherein like reference numerals are used to identify identical components in the various views, FIG. 1 shows an apparatus 10 for polishing a semiconductor wafer. Apparatus 10 includes, in one embodiment, polishing machine 12, controller 14, and memory 16.

Machine 12 is provided for performing the polishing function, and may be, a commercially available unit, Westech Model 372/472 Polishing Machine. Machine 12 includes a base 17, means, such as platen 18 and pad 20, for polishing a semiconductor wafer, means, such as carrier 22, for selectively receiving and retaining semiconductor wafer 24, mechanical arm 26, first pivot 27, vacuum source 28, second pivot 29 (FIG. 3B), and vacuum conduit 30.

Platen 18 may be one of a plurality of platens $\mathbf{18}_i$ found in machine 12 for purposes of receiving, respectively, varying hardnesses of polishing pads 20. For example, a first type of pad 20 may be a bulk polishing pad, a harder type of pad used at an earlier stage in the polishing process to effect a greater amount of abrasion. In a preferred environment in which the present invention is embodied, a finishing-type (final) pad is provided and affixed to platen 18 for rotation therewith. The final polishing pad is a softer type of pad and is used to effectively buff the surface of semiconductor wafer 24.

It should be appreciated by one of ordinary skill in the art that during the polishing process on a particular pad 20, a first phase involves applying a polishing fluid to the polishing pad by conventional means. Such polishing fluid may include a combination comprising fumed silica and potassium hydroxide (KOH). Near the end of the polishing process on the particular pad 20, a second phase is entered wherein the polishing fluid is replaced by purified water to effectively cleanse the wafer 24 of the slurry derived from use of the polishing fluid. Platen 18 is rotatable about an axis of rotation indicated at B, shown in FIG. 1, and is rotated by a conventional first drive means (not shown) under the control of controller 14 in accordance with the preprogrammed operating strategy stored in memory 16. As indicated above, the polishing pad 20, and the platen 18 rotate together as a unit, at an angular speed $\omega_p$. Speed $\omega_p$ is a parameter that is selectable, and which is included as part of the operating strategy.

Carrier portion 22 is, in one embodiment, generally cylindrical in shape, and is sized to accommodate semiconductor wafer 24 on one side thereof. Carrier 22 is rotatable about an axis of rotation indicated at A in FIG. 1, and is provided for selectively receiving and retaining semiconductor wafer 24 by application of a predetermined level of vacuum applied by vacuum source 28 by way of conduit 30. It should be understood that the illustration of the vacuum source and line is diagrammatic only, and is not intended to represent an actual technique for retaining the wafer to the carrier 22. The carrier 22 is rotated by a conventional second drive means (not shown) under the control of controller 14 in accordance with the preprogrammed operating strategy stored in memory 16. A parameter included in the operating strategy is the rotation speed of the carrier $\omega_c$, which may be user-selected and stored in memory 16.

Figure 2:
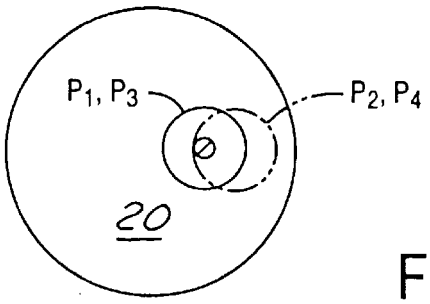
FIG. 2 is a simplified, diagrammatic top view showing the relative movements of the carrier portion of the machine of FIG. 1 during a pre-wafer-removal mode of operation.

Referring now to FIG. 2, in addition to FIG. 1, arm 26 is provided for moving carrier 22 between a first position indicated at $P_1$, and a second position $P_2$, following a path along the surface of polishing pad 20, which lies in a plane that is substantially parallel to platen 18. During polishing operations, arm 26 applies a downforce to carrier 22, which is coupled through wafer 24 to assist in the polishing process. The magnitude of the downforce is a parameter that forms part of the predetermined operating strategy, and which may be user selectable and stored in memory 16 for use by controller 14. In the illustrated embodiment, such a motion as is illustrated in FIG. 2 is permitted by means of a pivot connection 27 to base 17. It should be appreciated, however, that this connection is purely diagrammatic, and is not intended to be a limitation of the present invention. For example, other arrangements are possible that would permit movement between the first and second positions as shown in FIG. 2, for example, a bridge member spanning platen 18 that permits movement of carrier 22 without pivoting.

Figure 3A:
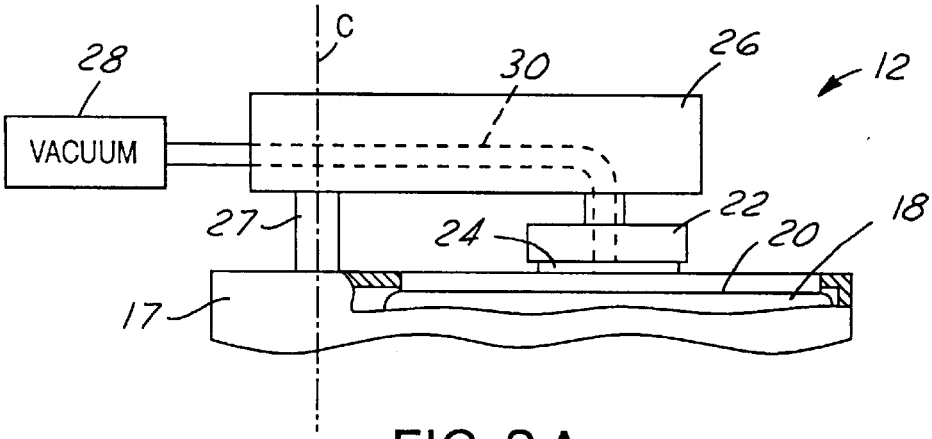
FIG. 3A is a simplified, diagrammatic side view of the polishing apparatus illustrated in FIG. 1 disposed in an engaged position operative for polishing a semiconductor wafer.
Figure 3B:
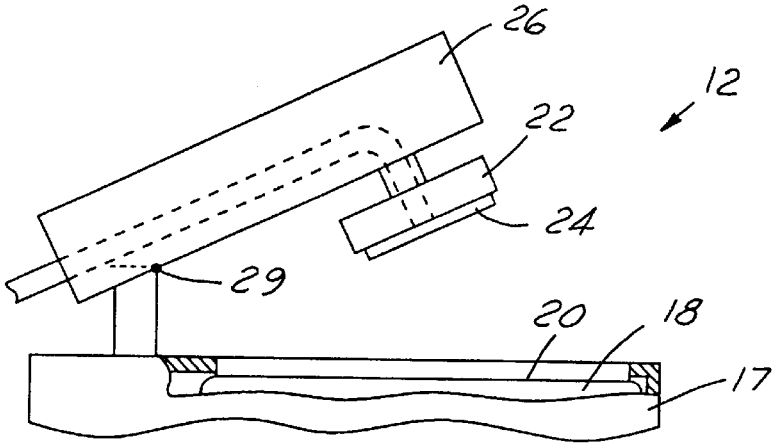
FIG. 3B is a simplified, diagrammatic side view of the polishing apparatus illustrated in FIG. 1 disposed in an opened position, after removal of the semiconductor wafer from the polishing pad after completion of the polishing cycle.

Referring now to FIGS. 3A, and 3B, arm 26 is also operative for moving carrier 22 between one position in which the carrier is moved towards the platen 18 wherein the wafer 24 engages pad 20 (FIG. 3A), and another position wherein carrier 24 is moved away from platen 18 after removal of the wafer 24 from polishing pad 20 (FIG. 3B). When in the engaged position (FIG. 3A), the axis of rotation of carrier 22 is substantially parallel to the axis of rotation of platen 18. As diagrammatically illustrated in FIG. 3B, pivot 29 permits the movement illustrated in FIGS. 3A, and 3B. It should be understood, however, that this structure is merely diagrammatic, and is in no way intended to limit the present invention to such structure. It should be further appreciated that there are a wide variety of equivalents well-known to those of ordinary skill in the art to perform the function of causing carrier 22 to move towards platen 18 so that wafer 24 engages pad 20, and, subsequently, after a polishing operation, to remove or lift wafer 24 from the pad. Such movement is accomplished by use of conventional drive and movement means well-known to those of ordinary skill in the art under the control of controller 14 according to the predetermined strategy stored in memory 16.

Controller 14 may be integrated with polishing machine 12, and may be a controller such as is provided with the Westech 372/472 polishing machine mentioned above. Memory 16 may be integral with controller 14, or may be a separate physical memory unit. By way of a user interface, various parameters related to the operation of machine 12 may be controlled, and, as alluded to above, collectively comprise the preselected operating strategy for machine 12. For example, rotation speeds $\omega_p$, and $\omega_c$ may be specified through the interface for storage in memory 16 for use by controller 14 in controlling the rotation speeds of the platen 18, and carrier 22, respectively. Furthermore, a parameter indicative of the speed, travel length, the number of iterations between positions $P_1$, and $P_2$, and the downforce applied by way of arm 26, may all be user-specified through the interface provided by controller 14, stored in memory 16, and used by controller 14 for operating machine 12.

Figure 4:
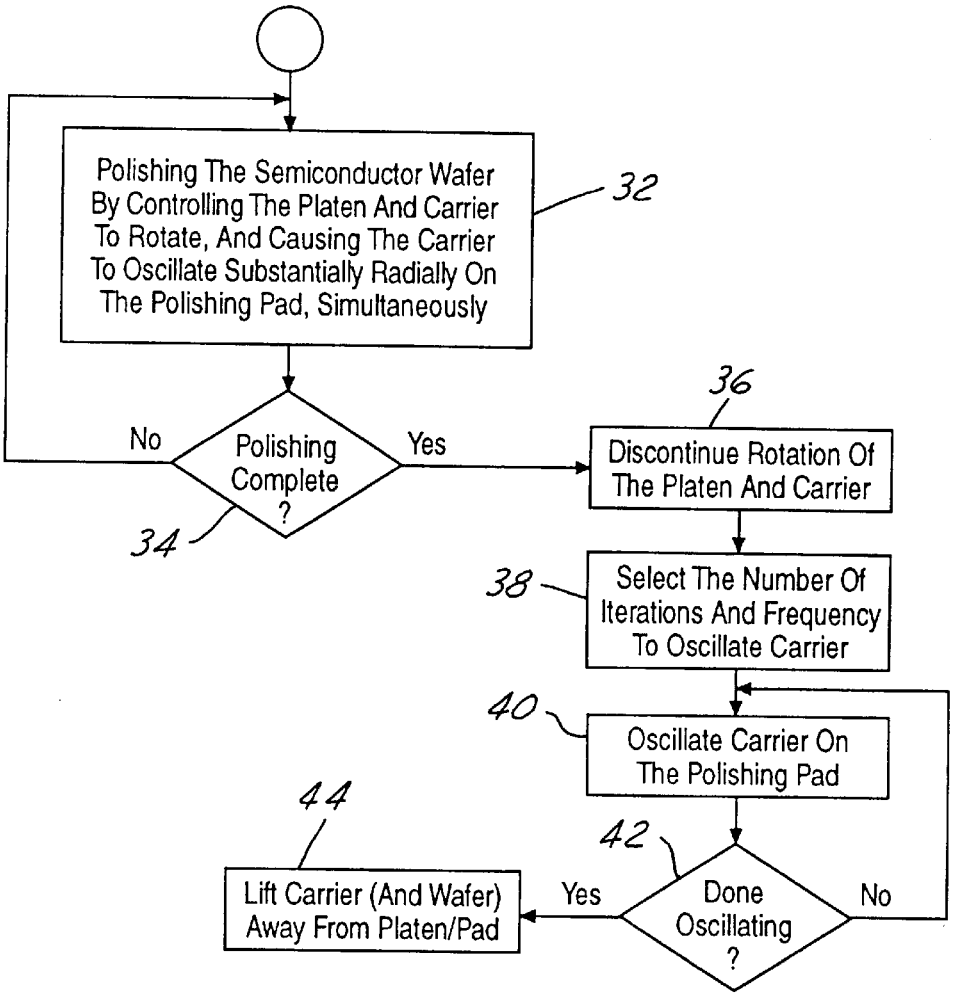
FIG. 4 is a flow-chart diagram illustrating the various steps involved in the operation of a preferred polishing machine embodiment according to the present invention.

Referring now to FIG. 4, the operation of an embodiment in accordance with the present invention will be set forth. As shown in block 32, during normal polishing operations, controller 14 is responsive to the predetermined operating strategy stored in memory 16 (defining a polishing mode of operation), which, as described above, contains various operating parameters initialized to preset values, for polishing the semiconductor wafer 24. Controller 14 accomplishes this task by commanding the various drive means (not shown) to simultaneously rotate platen 18 (and thus also pad 20) at a first speed $\omega_p$, in a first direction, rotating carrier 22 at a carrier speed $\omega_c$ in a second direction, which, as illustrated, may be the same orientation as that of the platen/pad, and, simultaneous with the above two rotations, cause carrier 22 to oscillate along the surface of pad 22 between the first and second positions $P_1$, and $P_2$. It should be understood, however, that the illustrated positions are not meant to be limiting in nature, but only descriptive of an embodiment of the present invention. In the preferred embodiment, the path between positions $P_1$, and $P_2$ extends in a substantially radial path, relative to axis B. This path, however, may be slightly arcuate. As those of skill in the art will recognize, the combination of the various rotations and motions provides for an even polishing effect on semiconductor wafer 24. During the first phase of the polishing, the above-described polishing fluid may be dispersed along and about the surface of pad 20 to assist in the polishing process. In the second phase of the polishing, the polishing fluid is replaced by purified water to cleanse the polishing pad and wafer 24 of slurry.

In step 34, controller 14 checks to determine whether the polishing is complete. For example, a total polishing time may be programmed as an operating parameter and used by controller 14 in determining when to discontinue the polishing procedure described above.

In step 36, controller 14 operates in accordance with the second predetermined strategy (defining a pre-wafer-removal mode of operation) stored in memory 16 for discontinuing rotation of platen 18, and carrier 22. Controller 14 controls the arm to move the carrier 22 (and thus also the water 24) between third and fourth positions, $P_3$, and $P_4$ on the surface of pad 20.

In a preferred embodiment the third and fourth positions correspond substantially to the first and second positions (as illustrated, and hereinafter, positions $P_1$ and $P_2$ will be referenced with respect to this post-polishing mode of operation and according to the invention). In the preferred embodiment, then, controller 14 maintains the movement of carrier 22 between the first and second positions $P_1$, $P_2$ used during the polishing process. To implement this oscillation, controller 14 selects or retrieves the preset number of iterations parameter (i.e., from position $P_1$-to-$P_2$-to-$P_1$), and a total wipe time parameter from memory 16, as shown in step 38. Since rotation of platen 18, and carrier 22 has been discontinued, rather than increased, as in the "Shear" method, this inventive technique may be referred to as an "Anti-shear" method.

In step 40, controller 14 commands various electromechanical drive means (not shown) to perform the desired oscillation of semiconductor wafer 24 on polishing pad 20. In the context of the use of a final polishing pad, the total length of time for oscillation ("wipe time") may be, in one embodiment, approximately ten seconds wherein the carrier moves semiconductor wafer 24 through five or six complete iterations between position $P_1$, and position $P_2$ and back to $P_1$. It has been determined that, for times less than ten seconds, the removal force needed to remove wafer 24 from pad 20 increases to an undesirable level, while at times more than ten seconds, the additional reductions in the separation-resisting force (e.g., suction) between wafer 24 and pad 20 do not merit the extra delay inserted in the wafer polishing process. Importantly, the downforce that is normally applied during the polishing phase, is nearly shut-off (i.e., the programmed downforce is only slightly greater than zero) during this post-polishing pre-wafer-removal mode of operation.

In step 42, controller 14 checks to determine whether the predetermined number of oscillations/total time (i.e., frequency) has elapsed. If the answer to this test is NO, then control is returned to step 40. Otherwise, control is passed to step 44.

In step 44, the arm 26 is controlled by controller 14 to lift the wafer 24 away from platen 18/pad 20.

It should be understood that while there are advantages in maintaining the same general oscillating motion of carrier 22 during the pre-wafer-removal mode of operation, as used during the polishing mode of operation, the present invention does not require it. For example, other paths along the surface of pad 20 may alternatively be used, and which may be different from the path used during the polishing mode of operation.

An apparatus and method for removing a semiconductor wafer from a polishing pad, according to the invention, significantly dissipates the attracting forces between the polishing pad 20, and the wafer 24, that arise during Chemical Mechanical Polishing thereby allowing the wafer 24 to be easily removed from the platen after the polishing operation. Significantly, the above-described "anti-shear" method and system permits 8-inch wafers to be easily removed from the polishing pad; conventional methods result in dropped wafers, and/or extreme arm forces, which are undesirable. The invention saves countless hours of machine/process downtime by alleviating the dropped wafer problem. Moreover, in contrast to conventional methods, wherein many of the dropped wafers were usually damaged to the point of having to be scrapped, the present invention substantially reduces or eliminates dropped wafers altogether.

While the invention has been particularly shown and described with reference to the preferred embodiments thereof, it is well understood by those skilled in the art that various changes and modifications can be made in the invention without departing from the spirit and scope thereof; the invention being limited only by the appended claims.

I claim:

1. An apparatus for polishing a semiconductor wafer, comprising:

first means rotatable about a first axis for polishing the wafer;

second means rotatable about a second axis for selectively receiving the semiconductor wafer;

means for moving said second means parallel to said first means and along a first path between first and second positions;

means for moving said second means in a direction toward said first means wherein the wafer engages said first means and said second axis is substantially parallel to said first axis, and further in a direction away from said first means;

means for simultaneously rotating said first means, and rotating and moving between said first and second positions said second means when in a polishing mode of operation to thereby polish the semiconductor wafer; and, means for discontinuing rotation of said first means and said second means, and moving said second means along a second path between third and fourth positions parallel to said first means when in a pre-wafer-removal mode of operation, wherein a separation resisting force between said first means and the wafer is reduced to thereby enable said second means and the wafer to be moved away from said first means.

2. The apparatus of claim 1 wherein said third and fourth positions substantially correspond to said first and second positions, respectively.

3. The apparatus of claim 1 wherein said first means comprises a platen for receiving a polishing pad.

4. The apparatus of claim 1 wherein said second means comprises a carrier coupled to a vacuum source for retaining the semiconductor wafer thereagainst.

5. The apparatus of claim 1 wherein said means for moving said second means parallel to said first means comprises an arm member rotatable about a third axis parallel to said first axis.

6. The apparatus of claim 1 wherein said second path extends substantially radially, relative to said first axis, between said first and second positions.

7. The apparatus of claim 1 wherein said means for moving said second means in a direction toward and away from said first means comprises an arm member movable in plane perpendicular to said first means.

8. The apparatus of claim 1 wherein said means for simultaneously rotating, and rotating and moving, comprises a control means responsive to an operating strategy stored in a memory means coupled with said control means for controlling said rotations, and movements.

9. The apparatus of claim 1 wherein said discontinuing and maintaining means comprises a control means responsive to an operating strategy stored in a memory means coupled with said control means for controlling said first and second means.

10. The apparatus of claim 9 wherein said operating strategy includes a parameter indicative of a number of iterations said second means travels said path between said first and second positions.

11. The apparatus of claim 9 wherein said operating strategy includes a parameter indicative of a frequency with which said second means traverses said path between said first and second positions.

12. The apparatus of claim 9 wherein said operating strategy includes a parameter indicative of a total time.

13. The apparatus of claim 1 further including means for disbursing polishing fluid on said polishing means.

14. An apparatus for polishing a semiconductor wafer, comprising:

a platen rotatable about a first axis for receiving a polishing pad for rotation therewith;

a carrier rotatable about a second axis for selectively receiving and retaining the semiconductor wafer;

an arm member for moving said carrier parallel to said platen and along a path between first and second positions, said arm member being moveable in a direction toward said platen wherein the wafer engages said polishing pad and said second axis is substantially parallel to said first axis, said arm member being further movable in a direction away from said platen; and, a controller responsive to a first operating strategy stored in a memory associated therewith for simultaneously rotating said platen, rotating said carrier, and moving said carrier between said first and second positions when in a polishing mode of operation to thereby polish the semiconductor wafer;

said controller being further responsive to a second strategy stored in said memory for discontinuing rotation of said platen and said carrier while maintaining said movement of said carrier between said first and second positions when in a pre-wafer-removal mode of operation, wherein a separation resisting force between said polishing pad and the wafer is reduced to thereby enable said carrier and the wafer to be moved away from said platen.

15. The apparatus of claim 14 wherein said second operating strategy includes a first parameter indicative of a number of iterations said carrier traverses said path between said first and second positions.

16. The apparatus of claim 15 wherein said second operating strategy further includes a second parameter indicative of a total time interval in which said iterations occur.

17. A method of operating a semiconductor wafer polishing apparatus having a platen rotatable about a first axis for receiving a polishing pad, a carrier rotatable about a second axis for receiving the semiconductor wafer, comprising the steps of:

(A) polishing the semiconductor wafer by simultaneously rotating the platen, rotating the carrier, and moving the carrier parallel to the platen and along a path between first and second positions; and, (B) discontinuing rotation of the platen and carrier while maintaining movement of the carrier between the first and second positions to thereby reduce a separation-resisting force between the wafer and the polishing pad.

18. The method of claim 17 wherein said polishing step includes the substep of:

disbursing polishing fluid on the polishing pad.

19. The method of claim 17 wherein said discontinuing rotation step is performed by the substeps including:

selecting a number of iterations and total time in which the carrier traverses the path between the first and second positions;

moving the carrier the number of iterations during the total time selected in the selecting step.

20. The method of claim 17 wherein said discontinuing rotation step is performed by the substeps including:

selecting a time interval in which the carrier traverses the path between the first and second positions; and, moving the carrier along the path between the first and second positions for the time interval selected in the selecting step.

* * * * *